US009056489B2

(12) United States Patent
Hirakawa

(10) Patent No.: US 9,056,489 B2
(45) Date of Patent: Jun. 16, 2015

(54) OPTICAL SCANNING DEVICE AND IMAGE FORMING APPARATUS INCLUDING THE SAME

(71) Applicant: KYOCERA DOCUMENT SOLUTIONS INC., Osaka (JP)

(72) Inventor: Hiroyuki Hirakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/224,007

(22) Filed: Mar. 24, 2014

(65) Prior Publication Data

US 2014/0292995 A1 Oct. 2, 2014

(30) Foreign Application Priority Data

Mar. 26, 2013 (JP) ..... 2013-063326

(51) Int. Cl.
*B41J 2/47* (2006.01)

(52) U.S. Cl.
CPC ..... *B41J 2/471* (2013.01)

(58) Field of Classification Search
CPC ..... B41J 2/47; B41J 2/471; G02B 26/121
USPC ..... 347/256–261
See application file for complete search history.

(56) References Cited

U.S. PATENT DOCUMENTS

2013/0135421 A1* 5/2013 Takahashi ..... 347/224

FOREIGN PATENT DOCUMENTS

| | | | | |
|---|---|---|---|---|
| JP | 2007-333917 | A | | 12/2007 |
| JP | 2008-055791 | A | | 3/2008 |
| JP | 2010-224083 | A | | 10/2010 |
| JP | 2010224083 | A | * | 10/2010 |
| JP | 2011-150005 | A | | 8/2011 |
| JP | 2011150005 | A | * | 8/2011 |

* cited by examiner

*Primary Examiner* — Sarah Al Hashimi
(74) *Attorney, Agent, or Firm* — Studebaker & Brackett PC

(57) ABSTRACT

An optical scanning device includes a rotating polygon mirror, a motor, a substrate, a heat releasing member and a heat transfer member. The rotating polygon mirror deflection scans light emitting by a light source. The motor rotatively drives the rotating polygon mirror. The substrate has a drive circuit part for controlling the motor. The heat releasing member releases heat generated from the substrate. The heat transfer member is sandwiched between the substrate and the heat releasing member to be compressively deformed. A receiving portion that part of the heat transfer member compressively deformed enters is formed in a first part of the heat releasing member in which the heat transfer member is provided.

8 Claims, 12 Drawing Sheets

OPTICAL SCANNING DEVICE AND IMAGE FORMING APPARATUS INCLUDING THE SAME

INCORPORATION BY REFERENCE

The present application claims priority under 35 U.S.C. §119 to Japanese Patent Application No. 2013-063326, filed on Mar. 26, 2013. The contents of this application are incorporated herein by reference in their entirety.

BACKGROUND

The present disclosure relates to an optical scanning device and an image forming apparatus including the optical scanning device.

In a known optical scanning device used in an electrophotographic image forming apparatus such as a laser printer, laser light emitted by a light source is reflected and deflected by a rapidly rotating polygon mirror. The laser light having been reflected by the polygon minor passes through an optical lens and then scans the surface of a photoconductive drum.

This optical scanning device includes a polygon motor, a driver IC and a substrate. The polygon motor drives and rotates the polygon minor. The driver IC is an IC (Integrated Circuit) for driving the polygon motor. On the substrate, the driver IC is mounted, and a bearing hole for catching the rotating shaft of the polygon motor is formed.

In this optical scanning device, if the polygon motor is operated at a high speed, heat generated from the driver IC becomes so excessively large that the optical lens may be thermally deformed, which leads to a problem of quality degradation of a printed image.

On the contrary, in another optical scanning device, an elastic heat transfer member is sandwiched between a substrate and a heat releasing member. Thus, the substrate is in contact with the heat releasing member via the heat transfer member. Accordingly, heat generated from a driver IC is rapidly transferred from the substrate through the heat transfer member to the heat releasing member.

In still another optical scanning device, an end portion of a metal cover housing a polygon mirror and a substrate is in direct contact with a driver IC. Thus, the metal cover can be used as a heat releasing member.

SUMMARY

An optical scanning device according to one aspect of the present disclosure includes a rotating polygon mirror, a motor, a substrate, a heat releasing member and a heat transfer member. The rotating polygon mirror deflection scans light emitting by a light source. The motor rotatively drives the rotating polygon minor. The substrate has a drive circuit part for controlling the motor. The heat releasing member releases heat generated from the substrate. The heat transfer member is sandwiched between the substrate and the heat releasing member to be compressively deformed. A receiving portion that part of the heat transfer member compressively deformed enters is formed in a first part of the heat releasing member in which the heat transfer member is provided.

An image forming apparatus according to another aspect of the present disclosure includes an optical scanning device. The optical scanning device includes a rotating polygon minor, a motor, a substrate, a heat releasing member and a heat transfer member. The rotating polygon mirror deflection scans light emitting by a light source. The motor rotatively drives the rotating polygon minor. The substrate has a drive circuit part for controlling the motor. The heat releasing member releases heat generated from the substrate. The heat transfer member is sandwiched between the substrate and the heat releasing member to be compressively deformed. A receiving portion that part of the heat transfer member compressively deformed enters is formed in a first part of the heat releasing member in which the heat transfer member is provided.

DETAILED DESCRIPTION

An embodiment of the present disclosure will now be described in detail with reference to the accompanying drawings. It is noted that the present disclosure is not limited to the following embodiment.

Figure 1:
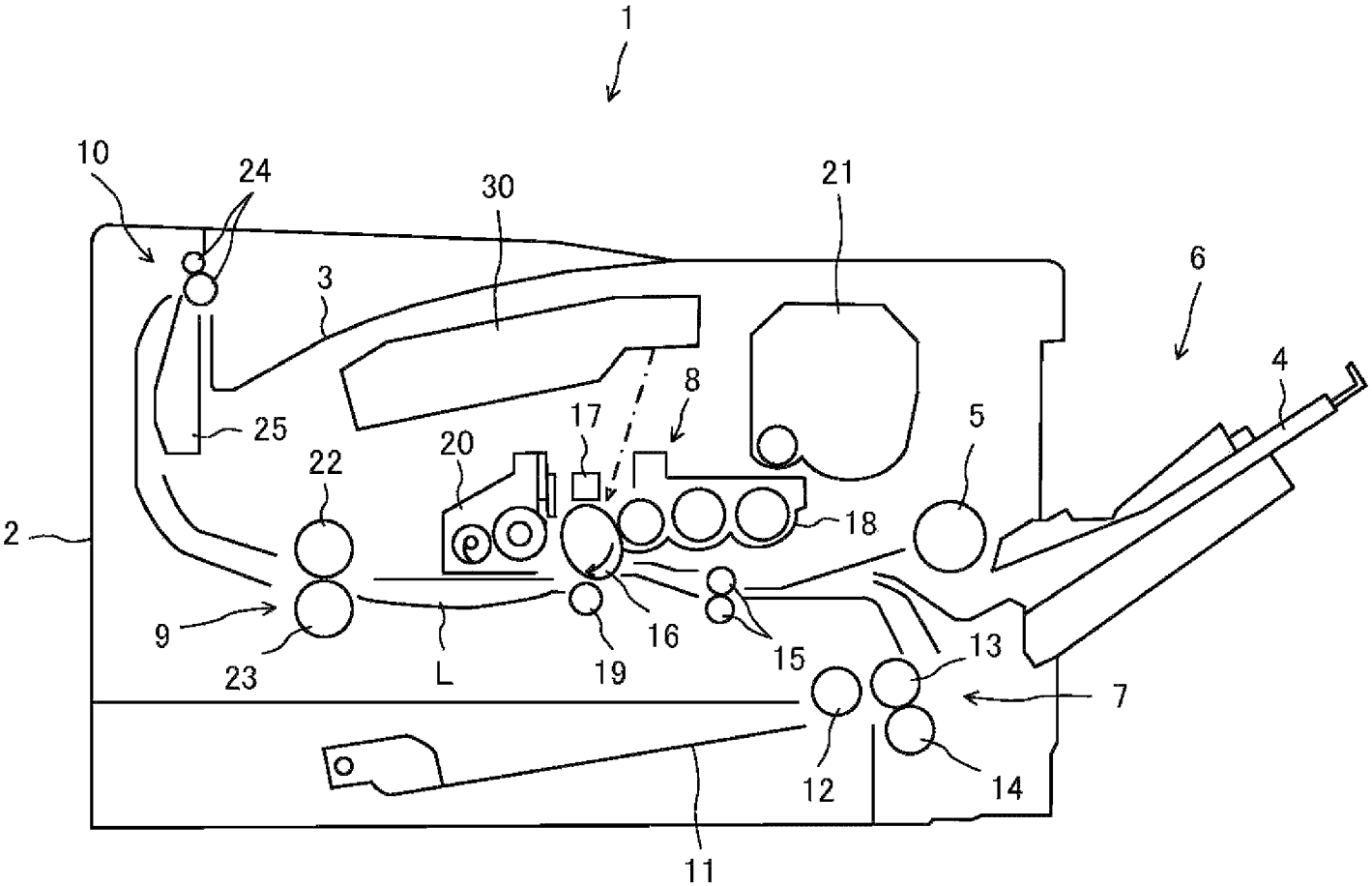
FIG. 1 is a cross-sectional view illustrating the schematic configuration of a laser printer described as an image forming apparatus according to an embodiment of the present disclosure.

FIG. 1 is a cross-sectional view illustrating the schematic configuration of a laser printer described as an image forming apparatus of the present embodiment. The laser printer 1 includes, as illustrated in FIG. 1, a box-shaped printer main body 2, a manual paper feeding section 6, a cassette paper feeding section 7, an image forming section 8, a fixing section 9 and a paper exit section 10. In the laser printer 1, an image is formed on paper based on image data transmitted from a terminal or the like not shown while conveying the paper along a conveyance path L within the printer main body 2.

The manual paper feeding section 6 includes a manual feed tray 4 and a paper feed roller 5. The manual feed tray 4 is openably provided in one end portion of the printer main body 2. The paper feed roller 5 is a roller rotatably provided for manual feed in the printer main body 2.

The cassette paper feeding section 7 is provided in a bottom portion of the printer main body 2. The cassette paper feeding section 7 includes a paper feed cassette 11, a pick roller 12, a feed roller 13 and a retard roller 14. The paper feed cassette 11 holds a pile of a plurality of paper. The pick roller 12 picks the paper held in the paper feed cassette 11 one by one. The feed roller 13 and the retard roller 14 separate each of the picked paper to feed it to the conveyance path L.

The image forming section 8 is provided above the cassette paper feeding section 7 in the printer main body 2. The image forming section 8 includes a photoconductive drum 16, a charging unit 17, a developing unit 18, a transfer roller 19, a cleaning unit 20, a laser scanning unit (LSU) 30 and a tonner hopper 21. The photoconductive drum 16 is an image bearing member rotatably provided in the printer main body 2. The charging unit 17 is disposed near the photoconductive drum 16. The laser scanning unit 30 is provided above the photoconductive drum 16. The image forming section 8 forms an image on paper fed from the manual paper feeding section 6 or the cassette paper feeding section 7.

It is noted that a pair of registration rollers 15 are provided on the conveyance path L. The registration rollers 15 temporarily hold the paper fed thereto and feed it to the image forming section 8 at prescribed timing.

The fixing section 9 is provided on a side of the image forming section 8. The fixing section 9 includes a fixing roller 22 and a pressure roller 23 pressed against each other and rotating together. The fixing section 9 fixes a toner image, which has been transferred onto the paper by the image forming section 8, on the paper.

The paper exit section 10 is provided above the fixing section 9. The paper exit section 10 includes an exit tray 3, a pair of exit rollers 24 and a plurality of conveyance guide ribs 25. The exit tray 3 is formed in the shape of a recess in an upper portion of the printer main body 2. The exit rollers 24 convey the paper to the exit tray 3. The conveyance guide ribs 25 guide the paper toward the pair of exit rollers 24.

When the laser printer 1 receives image data, the photoconductive drum 16 is rotatively driven and the charging unit 17 electrically charges the surface of the photoconductive drum 16 in the image forming section 8.

Then, laser light is emitted, on the basis of the image data, by the laser scanning unit 30 to the photoconductive drum 16. Thus, an electrostatic latent image is formed on the surface of the photoconductive drum 16 by the laser irradiation. The electrostatic latent image formed on the photoconductive drum 16 is developed by the developing unit 18, and thus visualized as a toner image.

Thereafter, the paper is pressed against the surface of the photoconductive drum 16 by the transfer roller 19. In this manner, the toner image having been formed on the photoconductive drum 16 is transferred to the paper. The paper to which the toner image has been transferred is heated and compressed by the fixing roller 22 and the pressure roller 23 in the fixing section 9. As a result, the toner image is fixed on the paper.

Figure 2:
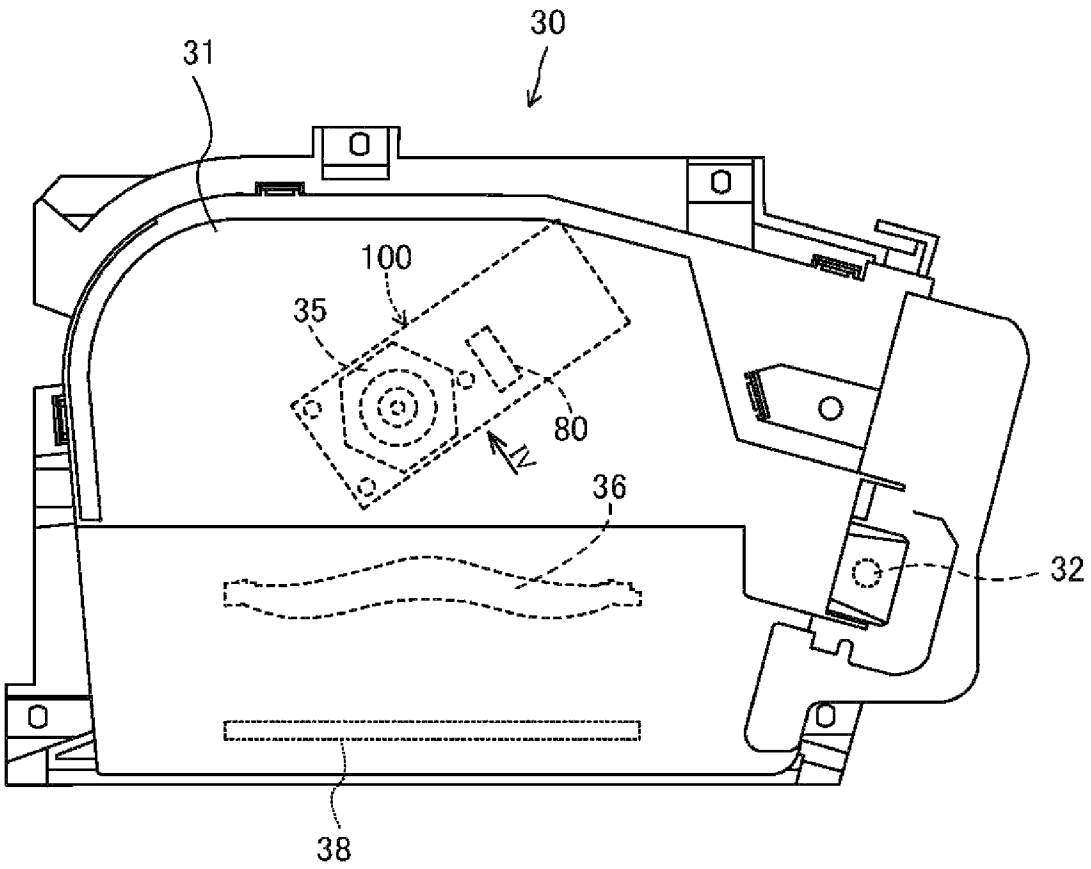
FIG. 2 is a plan view illustrating the appearance of a laser scanning unit described as an optical scanning device of the embodiment.

FIG. 2 is a plan view illustrating the appearance of the laser scanning unit described as an optical scanning device of the present embodiment.

The laser scanning unit 30 includes a light deflecting device 100, an image-forming lens 36, a housing 31 and a light source 32. The light deflecting device 100 deflects light emitted by the light source 32. The image-forming lens 36 is provided on an optical path of the light having been deflected by the light deflecting device 100. The housing 31 contains the light deflecting device 100 and the image-forming lens 36.

The light source 32 is provided, as illustrated in FIG. 2, on a side of the housing 31. The light source 32 is a laser light source including, for example, a laser diode. The light source 32 emits laser light toward a polygon mirror 35 described later. Although not illustrated in the drawings, for example, a collimator lens and a cylindrical lens are provided between the light source 32 and the polygon mirror 35.

Figure 3:
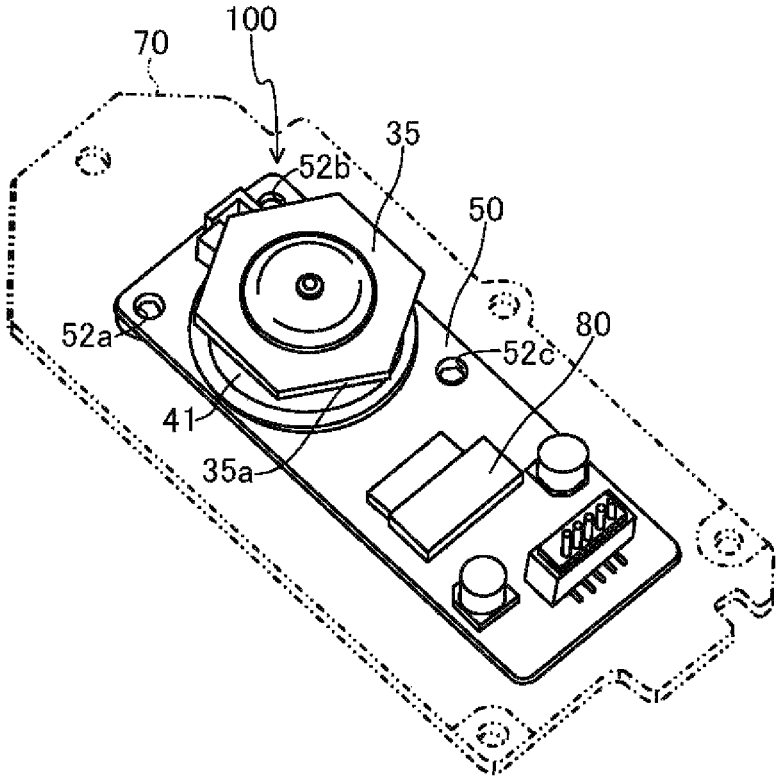
FIG. 3 is a perspective view of a light deflecting device of the embodiment.

The light deflecting device 100 includes, as illustrated in FIG. 3, the polygon mirror 35, a polygon motor 41 and a circuit substrate 50.

The polygon mirror 35 is in a polygonal shape. The polygon mirror 35 has a plurality of reflecting faces 35*a* on its peripheral surface. The reflecting faces 35*a* are used for reflecting the laser light emitted by the light source 32 toward the photoconductive drum 16 for scanning the surface thereof. The polygon minor 35 is rotatively driven by the polygon motor 41 provided on the circuit substrate 50.

The polygon motor 41 includes a rotating shaft 42 (see FIG. 4) and a circular air bearing (not shown). The rotating shaft 42 extends in the vertical direction to be vertical to the circuit substrate 50. The polygon mirror 35 is attached to an upper end portion of the rotating shaft 42 so as to be rotatable integrally with the rotating shaft 42. The air bearing rotatably supports the rotating shaft 42.

Figure 4:
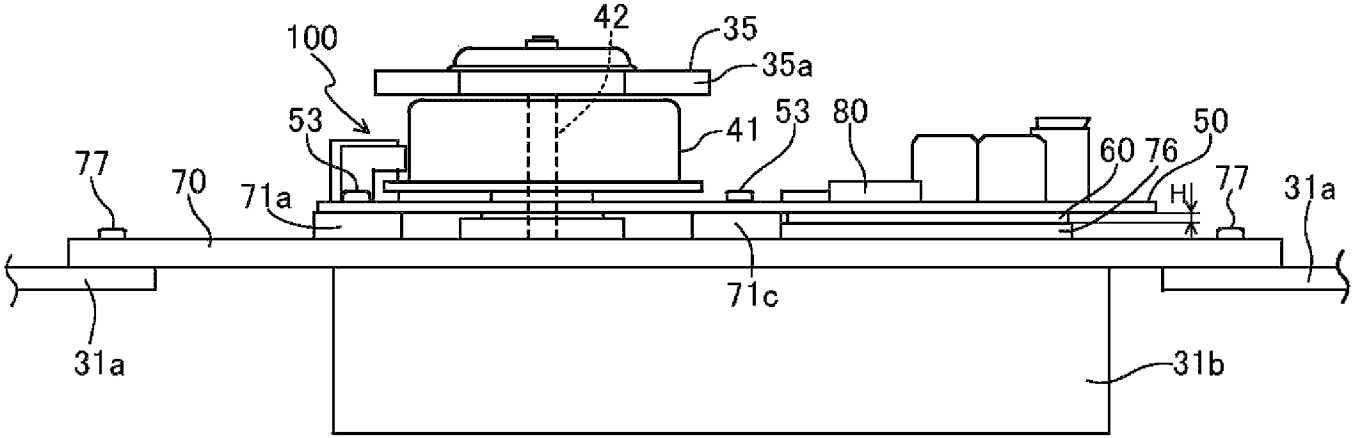
FIG. 4 is a view taken in the direction of an arrow IV of FIG. 2.
Figure 5:
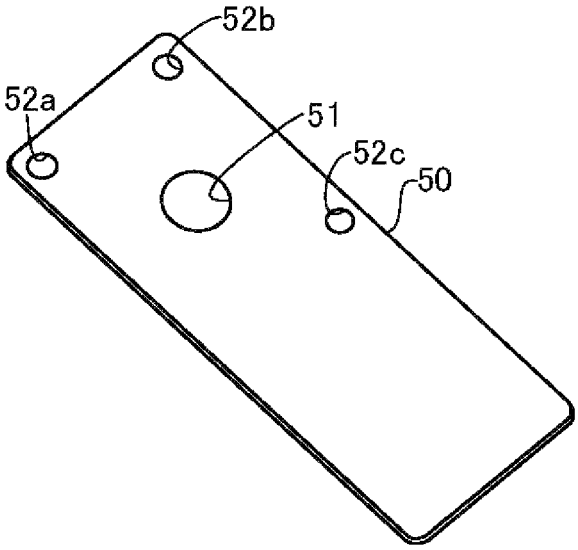
FIG. 5 is a perspective view of a circuit substrate of the embodiment.

As illustrated in FIGS. 3 to 5, the circuit substrate 50 is made of a substantially rectangular board. On the upper surface of the circuit substrate 50, a driver IC 80 (corresponding to a drive circuit part) for driving the polygon motor 41 is mounted. The driver IC 80 is in the shape of a thin rectangular block extending in the widthwise direction of the circuit substrate 50. The driver IC 80 is electrically connected to a controller not shown. The controller receives an instruction issued from an external terminal such as a personal computer, and outputs a signal for controlling the polygon motor 41 to the driver IC 80.

A bearing hole 51 is formed in the circuit substrate 50. The bearing hole 51 rotatably catches the rotating shaft (shaft member) 42 of the polygon motor 41. The air bearing is provided coaxially with the bearing hole 51 on the upper surface of the circuit substrate 50.

In the circuit substrate 50, three mounting holes 52*a*, 52*b* and 52*c* used for attaching the circuit substrate 50 onto the housing 31 are further formed. The two mounting holes 52*a* and 52*b* are formed at two corners close to the bearing hole 51 out of the four corners of the circuit substrate 50. The remaining one mounting hole 52*c* is formed in the vicinity of one side extending along the widthwise direction of the circuit substrate 50.

The circuit substrate 50 is fixed, with screws 53 inserted through the three mounting holes 52*a*, 52*b* and 52*c*, on the housing 31 together with a heat transfer sheet 60 and a heat sink 70 described later (see FIG. 4).

Figure 6A:
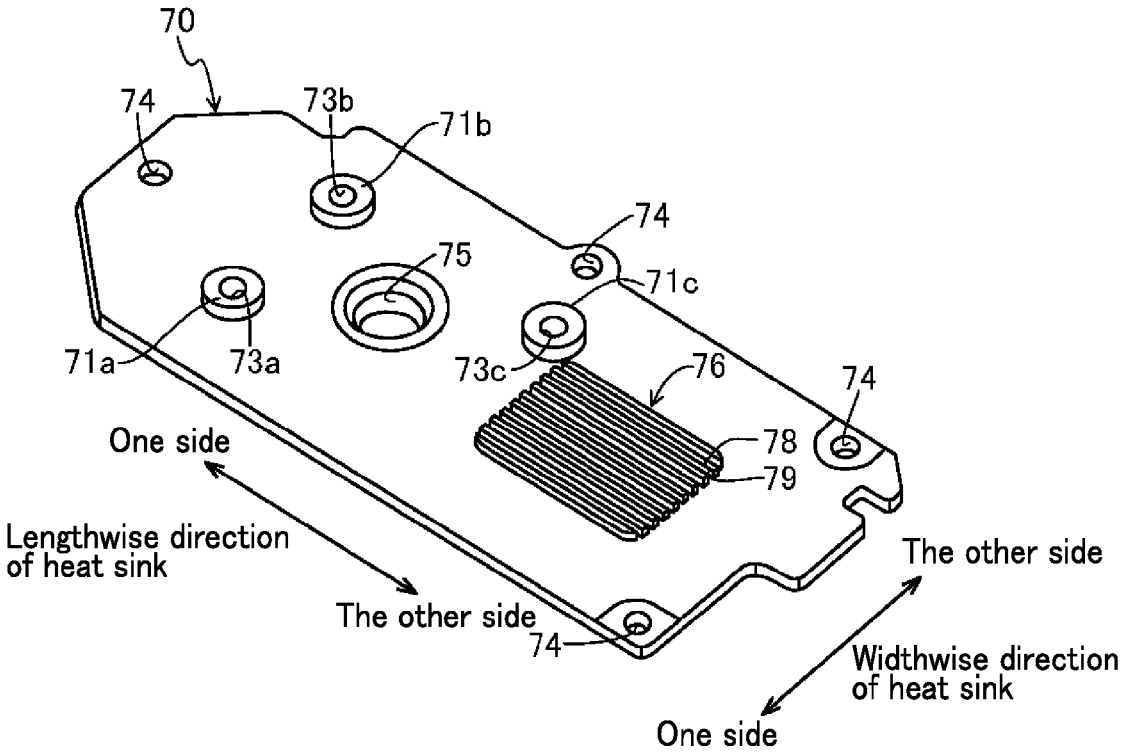
FIG. 6A is a perspective view of a heat releasing member of the embodiment.

The heat sink 70 is a member for releasing heat generated from the bearing hole 51 and the driver IC 80. As illustrated in FIG. 6A, the heat sink 70 is in the shape of a plate having a larger thickness than the circuit substrate 50. The circuit substrate 50 is placed on the heat sink 70. The heat sink 70 is preferably made of a metal member having excellent heat conductivity such as aluminum.

Three cylindrical bosses 71*a*, 71*b* and 71*c* are formed on the upper surface of the heat sink 70. The bosses 71*a*, 71*b* and 71*c* are formed in positions respectively corresponding to the mounting holes 52*a*, 52*b* and 52*c*. In the bosses 71*a*, 71*b* and 71*c*, fixing through holes 73*a*, 73*b* and 73*c* are respectively formed. The upper surfaces of the bosses 71*a*, 71*b* and 71*c* are comparatively precisely molded, so as to work as bearing surfaces for the circuit substrate 50.

Four through holes 74 are formed in a peripheral portion of the heat sink 70. The peripheral portion of the heat sink 70 is fixed, with screws 77 (see FIG. 4) inserted through the through holes 74, on a horizontal support 31 a provided in the housing 31. Besides, a though hole 75 is formed in the heat sink 70 in a position corresponding to the bearing hole 51. The through hole 75 catches the rotating shaft 42 of the polygon motor 41.

The heat transfer sheet 60 is made of an elastic thin sheet member of, for example, rubber.

Figure 6B:
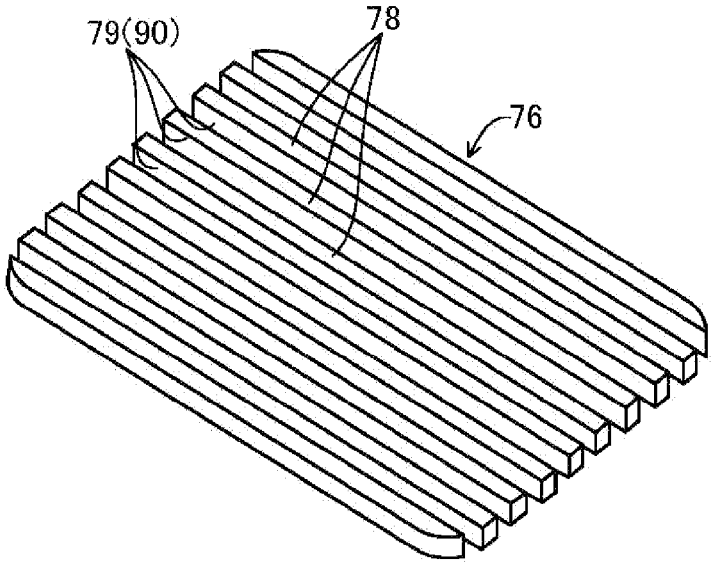
FIG. 6B is an enlarged view of a heat transfer sheet attaching part of the heat releasing member of the embodiment.

The heat transfer sheet 60 is sandwiched between the circuit substrate 50 and the heat sink 70, both fixed on the housing 31, so as to be compressively deformed. As illustrated in FIGS. 6A and 6B, on the upper surface of the heat sink 70, a heat transfer sheet attaching part 76 (a first part) in which the heat transfer sheet 60 is provided is formed. In the present embodiment, the heat transfer sheet attaching part 76 has a plurality of projections 78 (convexes) each in the shape of a substantially rectangular parallelepiped extending in the lengthwise direction of the heat sink 70. The upper surfaces of the plurality of projections 78 function as contact surfaces to be in contact with the heat transfer sheet 60. The plural projections 78 are disposed at prescribed intervals along the widthwise direction of the heat sink 70. Between adjacent projections 78, trenches 79 (concaves) are formed. In a side view of the heat transfer sheet attaching part 76 taken in the lengthwise direction of the heat sink 70, the projections 78 and the trenches 79 are alternately arranged to form a comb shape. The trenches 79 function as receiving portions 90 that part of the compressively deformed heat transfer sheet 60 enters. In the case where the actual dimensions of the heat sink 70, the substrate 50 and the heat transfer sheet 60 accord with their theoretical dimensions (namely, in the case where the dimensional tolerance is 0 (zero)), the volume of the trenches 79 is preferably set to be sufficiently large so that the entire spaces of the trenches 79 cannot be filled with the heat transfer sheet 60.

In the laser scanning unit 30, the laser light emitted by the light source 32 is collimated by, for example, a collimator lens. Thereafter, the laser light is collected on the reflecting face 35*a* of the polygon mirror 35 by a cylindrical lens. The light collected on the reflecting face 35*a* of the polygon mirror 35 is reflected by the reflecting face 35*a* of the polygon mirror 35 and then enters the image-forming lens 36 as scanning light. The scanning light having passed through the image-forming lens 36 is reflected by a steering minor 38 toward the photoconductive drum 16 disposed outside the housing 31 via an opening not shown. In this manner, the scanning light is imaged on the photoconductive drum 16. The scanning light having been imaged on the photoconductive drum 16 scans the surface of the photoconductive drum 16 in a main scanning direction in accordance with the rotation of the polygon mirror 35. Besides, the scanning light scans the surface of the photoconductive drum 16 in a sub scanning direction in accordance with the rotation of the photoconductive drum 16. As a result, an electrostatic latent image is formed on the surface of the photoconductive drum 16.

Here, in order to increase the speed of image formation by the laser printer 1, it is necessary to increase the rotational speed of the polygon motor 41. When the polygon motor 41 is driven at a high speed, a drive current for driving the polygon motor 41 is increased, and hence, the amount of heat generated from the driver IC 80 is increased.

In the present embodiment, the circuit substrate 50 on which the driver IC 80 is mounted is fixed on the heat sink 70 with the heat transfer sheet 60 disposed therebetween, and therefore, the heat generated from the driver IC 80 is rapidly transferred through the heat transfer sheet 60 to the heat sink 70. Accordingly, the temperature of the circuit substrate 50 can be prevented from excessively increasing, so that an optical lens (such as the image-forming lens 36) disposed in the housing 31 can be prevented from being deformed by the heat generated by the driver IC 80.

In some cases, a distance H (see FIG. 4) between the circuit substrate 50 and the heat sink 70 may be excessively small as compared with the thickness of the heat transfer sheet 60 due to, for example, a process error or an assembly error. In such a case, the amount of compressive deformation of the heat transfer sheet 60 becomes excessively large. It is noted that the distance H corresponds to a distance between the lower surface of the circuit substrate 50 and the upper surfaces of the respective projections 78 of the heat transfer sheet attaching part 76.

In this case, according to the present embodiment, part of the heat transfer sheet 60 compressively deformed enters the trenches 79 formed between the adjacent projections 78 of the heat sink 70. Thus, the heat transfer sheet 60 can be prevented from being excessively compressed. Accordingly, even if there is an error in the dimensional accuracy among the respective components of the circuit substrate 50, the heat transfer sheet 60, the heat sink 70 and the like, deformation of the circuit substrate 50 caused by a reaction force applied from the heat transfer sheet 60 can be suppressed. Besides, since the deformation of the circuit substrate 50 is thus suppressed, inclination of the shaft in the bearing hole 51 can be prevented.

According to the present embodiment, even if there is an error in the dimensional accuracy among the respective components, the inclination of the shaft in the bearing hole can be prevented while efficiently releasing heat generated from the drive circuit part. Accordingly, the quality of a printed image can be improved by employing an inexpensive configuration.

Figure 7A:
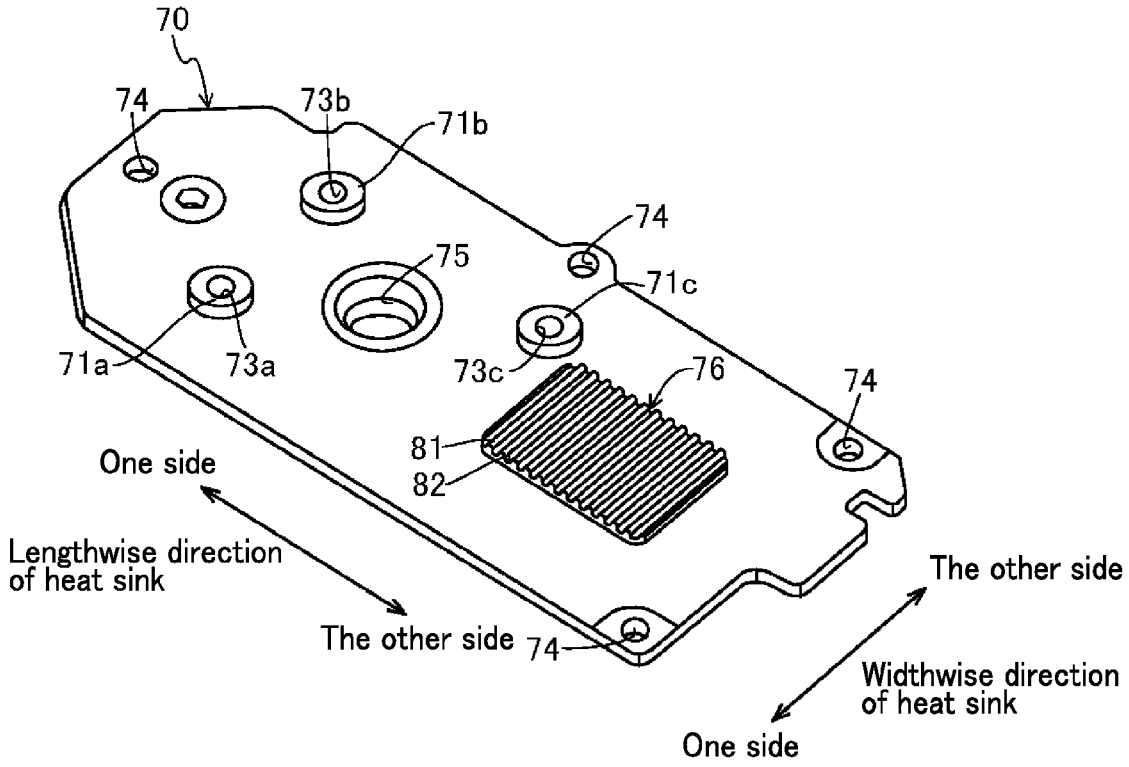
FIG. 7A is a perspective view of a heat releasing member according to Modification 1.
Figure 7B:
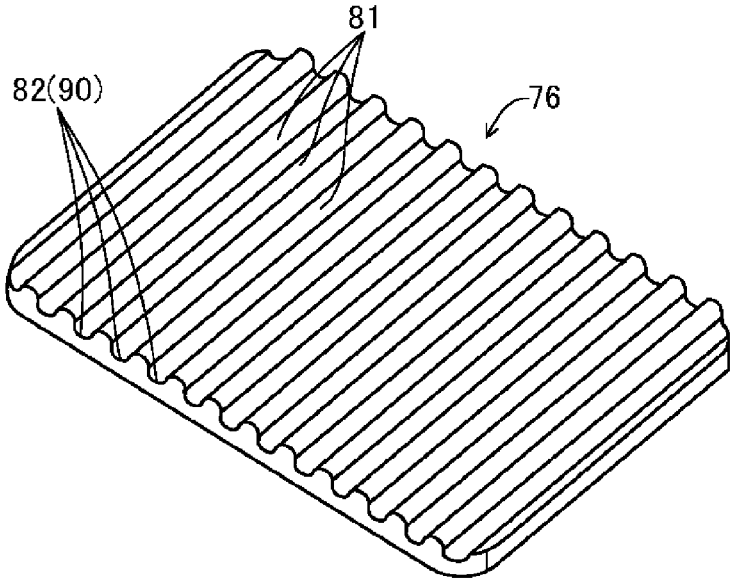
FIG. 7B is an enlarged view of a heat transfer sheet attaching part of the heat releasing member of Modification 1.

FIGS. 7A and 7B illustrate Modification 1 of the present embodiment. In this modification, the shape of the heat transfer sheet attaching part 76 is different from that of the above-described embodiment. Like reference numerals are used to refer to like elements, so as to omit the detailed description of the modification.

In Modification 1, the heat transfer sheet attaching part 76 is formed to have a wavy upper surface. For example, a member (a first member) having a wavy upper surface is provided in the heat transfer sheet attaching part 76. More specifically, in a side view of the heat transfer sheet attaching part 76 taken in the widthwise direction of the heat sink 70, projections 81 each having an arc-shaped cross-section and concaves 82 each having an arc-shaped cross-section are alternately arranged to form a wavy surface. The concaves 82 (concaves of the wavy surface) function as the receiving portions 90 that part of the heat transfer sheet 60 compressively deformed enters.

According to Modification 1, since the concaves 82 functioning as the receiving portions 90 are formed in the heat transfer sheet attaching part 76 of the heat sink 70, the same effect as that of the embodiment can be attained. Specifically, the heat transfer sheet 60 is sandwiched between the heat sink 70 an the circuit substrate 50 to be compressively deformed, so that part of the heat transfer sheet 60 can enter the concaves 82 (the receiving portions 90). Accordingly, excessive compression of the heat transfer sheet 60 can be prevented.

Figure 8A:
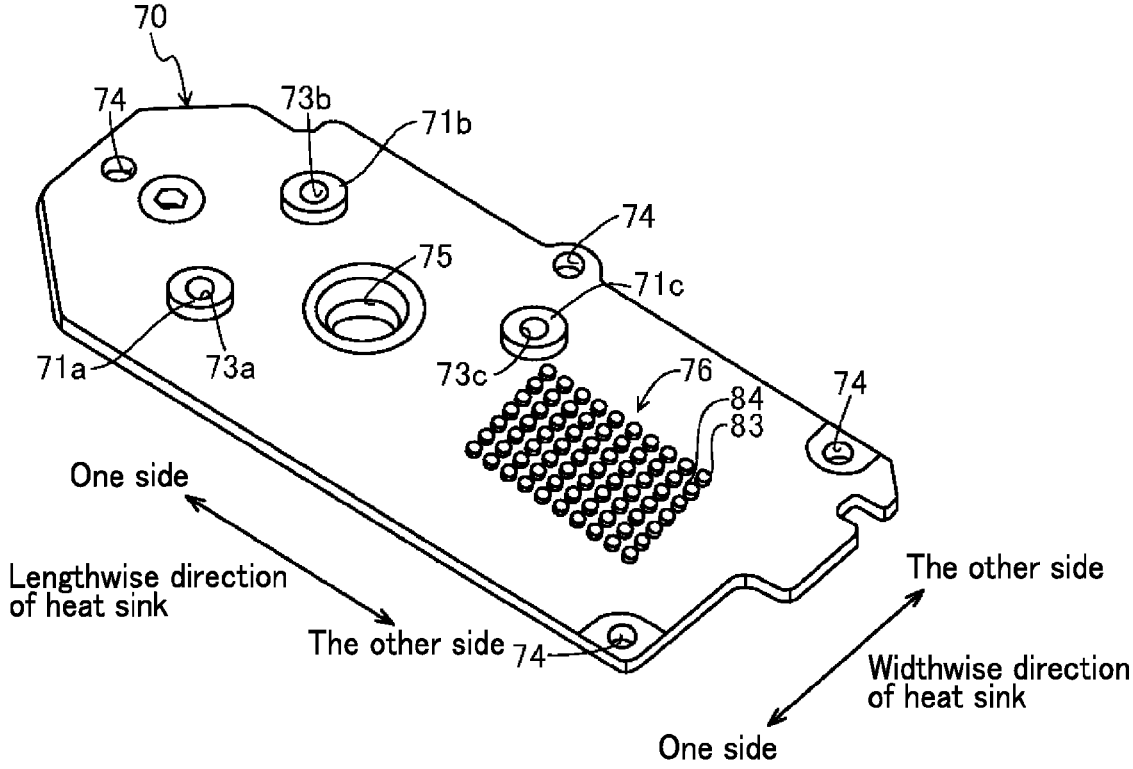
FIG. 8A is a perspective view of a heat releasing member according to Modification 2.
Figure 8B:
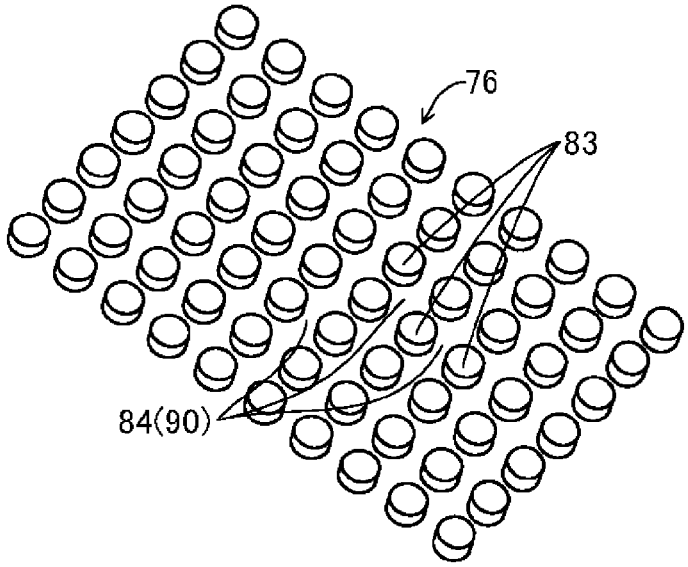
FIG. 8B is an enlarged view of a heat transfer sheet attaching part of the heat releasing member of Modification 2.

FIGS. 8A and 8B illustrate Modification 2 of the present embodiment. In Modification 2, the heat transfer sheet attaching part 76 has a plurality of cylindrical bosses 83 (convexes). The plural bosses 83 are arranged at prescribed intervals both in the lengthwise direction and the widthwise direction of the heat sink 70. Gaps 84 (concaves) formed between adjacent bosses 83 function as the receiving portions 90 that part of the compressively deformed heat transfer sheet 60 enters.

According to Modification 2, since the heat transfer sheet attaching part 76 of the heat sink 70 has the gaps 84 working as the receiving portions 90, the same effect as that of the embodiment can be attained. Specifically, the heat transfer sheet 60 is sandwiched between the plural bosses 83 and the circuit substrate 50 to be compressively deformed, so that part of the heat transfer sheet 60 can enter the gaps 84 (the receiving portions 90). Accordingly, excessive compression of the heat transfer sheet 60 can be prevented.

Figure 9A:
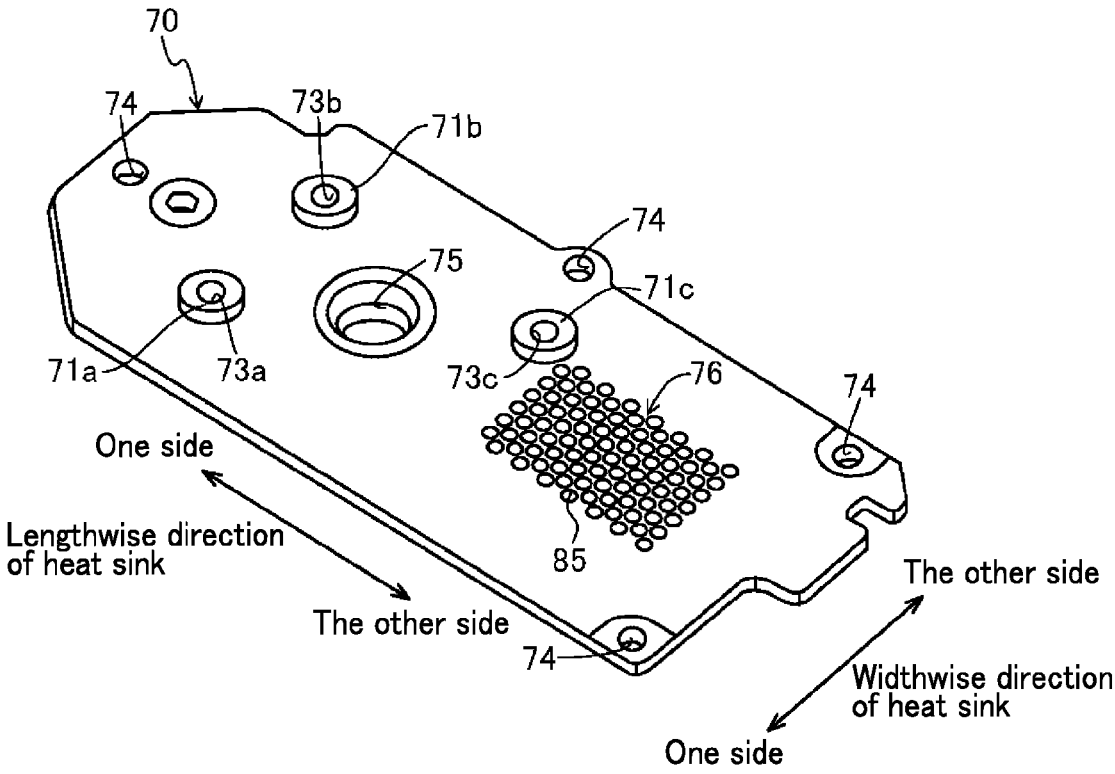
FIG. 9A is a perspective view of a heat releasing member according to Modification 3.
Figure 9B:
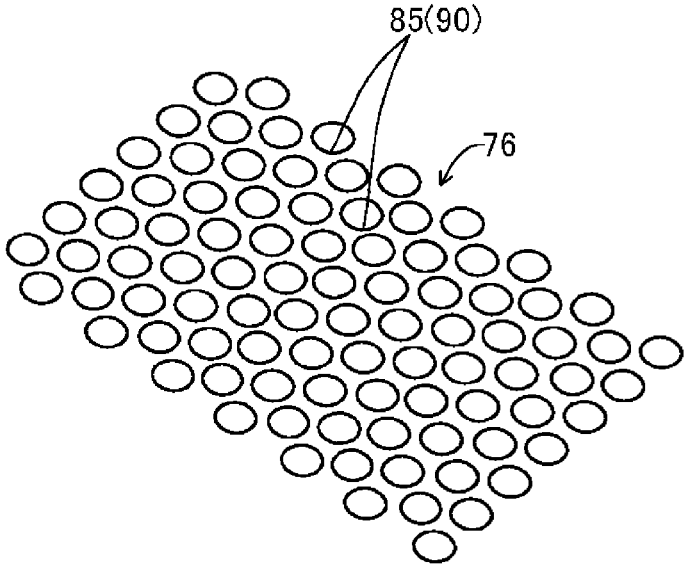
FIG. 9B is an enlarged view of a heat transfer sheet attaching part of the heat releasing member of Modification 3.

FIGS. 9A and 9B illustrate Modification 3 of the present embodiment. In Modification 3, the heat transfer sheet attaching part 76 has a plurality of circular holes 85. The plural circular holes 85 are arranged at prescribed intervals both in the lengthwise direction and the widthwise direction of the heat sink 70. The circular holes 85 function as the receiving portions 90 that part of the compressively deformed heat transfer sheet 60 enters.

According to Modification 3, since the heat transfer sheet attaching part 76 of the heat sink 70 has the circular holes 85 working as the receiving portions 90, the same effect as that of the embodiment can be attained. Specifically, the heat transfer sheet 60 is sandwiched between the heat sink 70 and the circuit substrate 50 to be compressively deformed, so that part of the heat transfer sheet 60 can enter the circular holes 85 (the receiving portions 90). Accordingly, excessive compression of the heat transfer sheet 60 can be prevented.

Figure 10A:
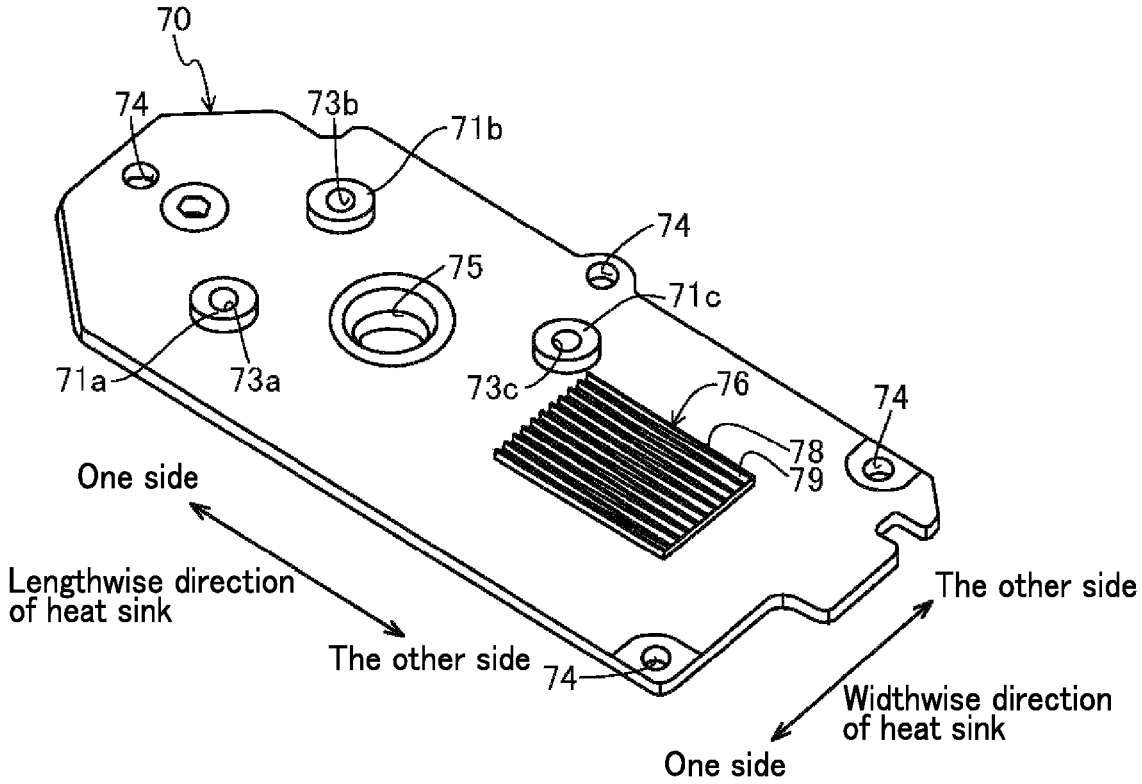
FIG. 10A is a perspective view of a heat releasing member according to Modification 4.
Figure 10B:
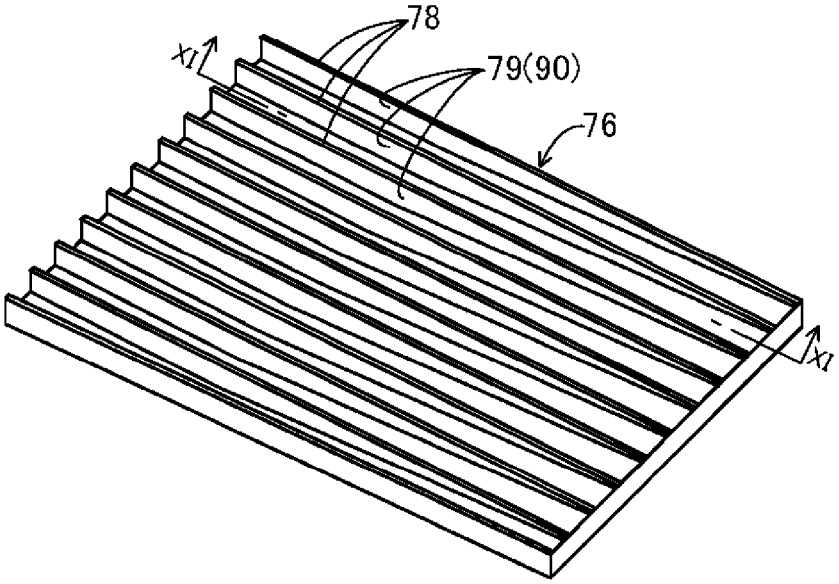
FIG. 10B is an enlarged view of a heat transfer sheet attaching part of the heat releasing member of Modification 4.

FIGS. 10A and 10B illustrate Modification 4 of the present embodiment. In Modification 4, the receiving portions 90 are provided as the trenches 79 formed between the adjacent projections 78 in the same manner as in the embodiment, but the trenches 79 of Modification 4 are different in the shape from the trenches 79 of the embodiment.

Figure 11:
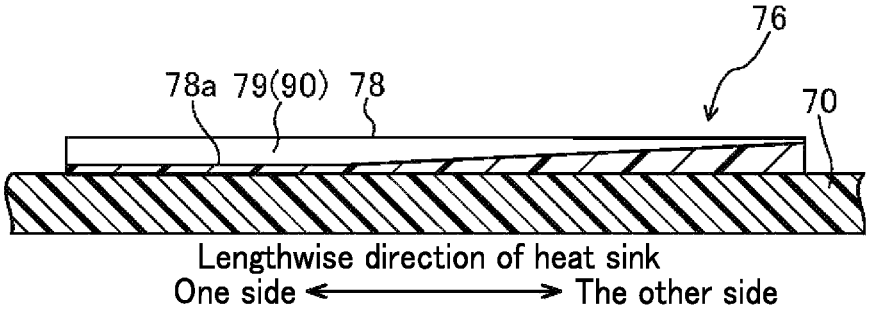
FIG. 11 is a cross-sectional view taken on line XI-XI of FIG. 10B.

As illustrated in FIG. 11, each trench 79 of Modification 4 has a bottom 78*a* inclined upward from one side to the other side in the lengthwise direction of the heat sink 70. Therefore, the depth of each trench 79 becomes larger from the other side to the one side in the lengthwise direction of the heat sink 70. In other words, the volume of each trench 79 becomes larger from the other side to the one side in the lengthwise direction of the heat sink 70. In Modification 4, the depth of each trench 79 becomes larger from a side farther from the bearing hole 51 (the through hole 75) of the heat transfer sheet attaching part 76 (i.e., the second side) to a side closer to the bearing hole 51 (the through hole 75) of the heat transfer sheet attaching part 76 (i.e., the first side).

Accordingly, in Modification 4, the volume of each receiving portion 90 (each trench 79) becomes larger on the side closer to the bearing hole 51 than on the side farther from the bearing hole 51. Therefore, the amount of compression of the heat transfer sheet 60 sandwiched between the heat sink 70 and the circuit substrate 50 can be made smaller on the side closer to the bearing hole 51 of the circuit substrate 50 than on the side farther from the bearing hole 51. Besides, the reaction force applied to the circuit substrate 50 by the heat transfer sheet 60 can be made smaller on the side closer to the bearing hole 51 than on the side farther from the bearing hole 51. Accordingly, in Modification 4, deformation of the circuit substrate 50 in the vicinity of the bearing hole 51 caused by the reaction force applied by the heat transfer sheet 60 can be suppressed. In addition, the inclination of the shaft in the bearing hole 51 can be definitely prevented.

Figure 12A:
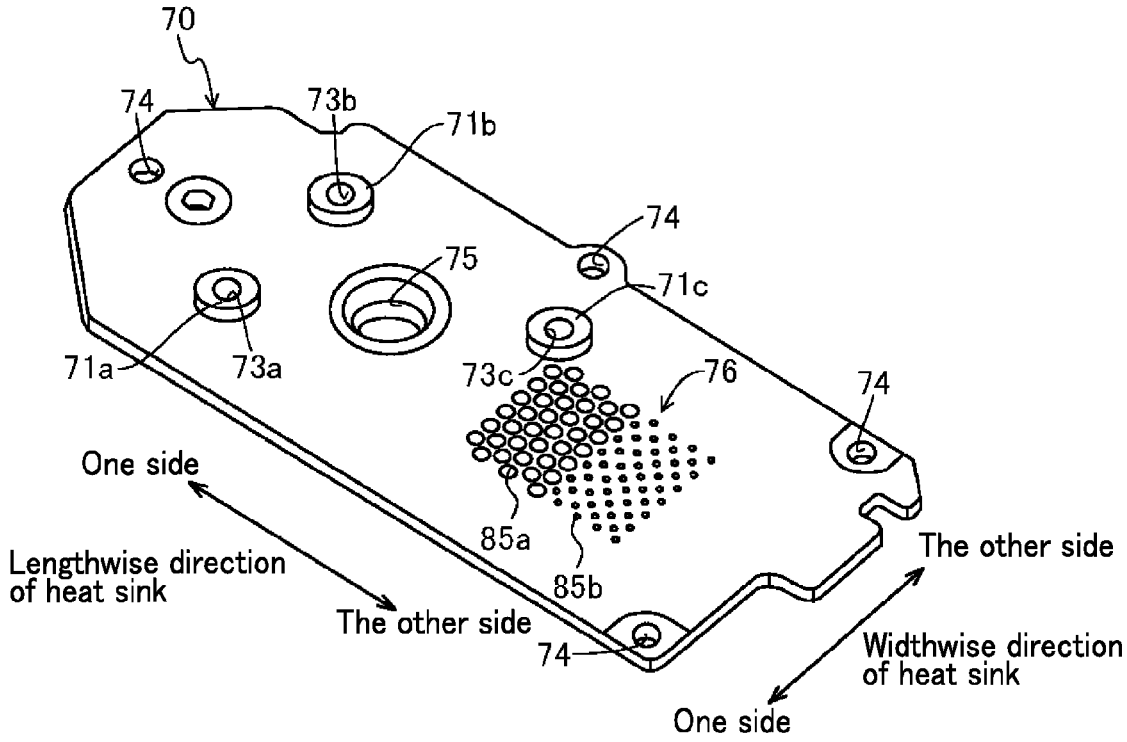
FIG. 12A is a perspective view of a heat releasing member according to Modification 5.
Figure 12B:
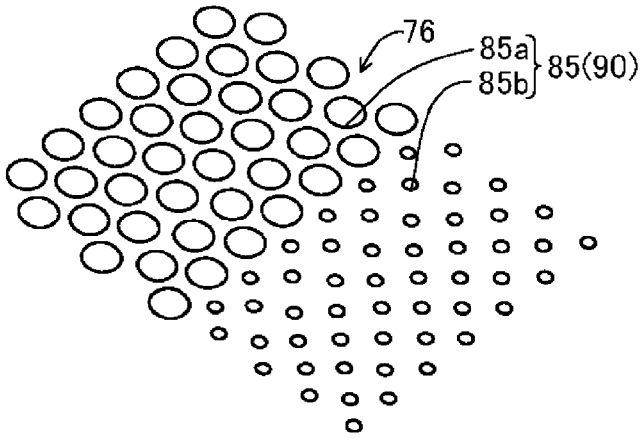
FIG. 12B is an enlarged view of a heat transfer sheet attaching part of the heat releasing member of Modification 5.

FIGS. 12A and 12B illustrate Modification 5 of the present embodiment. In Modification 5, the receiving portions 90 for the heat transfer sheet 60 are formed as a plurality of circular holes 85 in the same manner as in Modification 3.

In Modification 5, the plural circular holes 85 include a plurality of large holes 85*a* and a plurality of small holes 85*b*. Here, each large hole 85*a* has a diameter larger than that of each small hole 85*b*. In Modification 5, some of circular holes 85 disposed on one side along the lengthwise direction of the heat sink 70, for example, six rows of circular holes 85 disposed on the one side, are large holes 85*a*. Besides, others of circular holes 85 disposed on the other side along the lengthwise direction of the heat sink 70, for example, eight rows of circular holes 85 disposed on the other side, are small holes 85*b*. In Modification 5, the circular holes 85 disposed on the one side along the lengthwise direction of the heat sink 70 correspond to the circular holes 85 on the side closer to the bearing hole 51. Also, the circular holes 85 disposed on the other side along the lengthwise direction of the heat sink 70 correspond to the circular holes 85 on the side farther from the bearing hole 51.

Accordingly, in Modification 5, the volumes of the receiving portions 90 (the circular holes 85) are larger on the side closer to the bearing hole 51 than on the side farther from the bearing hole 51. Therefore, in the same manner as in Modification 4, the deformation of the circuit substrate 50 in the vicinity of the bearing hole 51 caused by the reaction force applied by the heat transfer sheet 60 can be suppressed. Besides, the inclination of the shaft in the bearing hole 51 can be definitely prevented. The embodiment of the present disclosure has been described so far, and it is noted that the present disclosure is not limited to this embodiment but can be practiced with various changes and modifications made within the scope of the present disclosure.

In the present embodiment and Modification 4, the widths of the individual trenches 79 (the receiving portions 90) can be constant or different. For example, the widths of the trenches 79 may be larger as they are closer to the bearing hole 51.

In Modification 1, the widths of the individual concaves 82 (the receiving portions 90) can be constant or different. For example, the widths of the concaves 82 may be larger as they are closer to the bearing hole 51.

In Modification 2, the plurality of bosses 83 may be arranged at equal intervals or different intervals in the widthwise direction and the lengthwise direction of the heat sink 70. For example, the intervals between the bosses 83 may be larger as they are closer to the bearing hole 51. In this case, among the plural gaps 84, the gap 84 disposed on the side closer to the bearing hole 51 has a larger volume than the gap 84 disposed on the side farther from the bearing hole 51. Therefore, the deformation of the circuit substrate 50 in the vicinity of the bearing hole 51 caused by the reaction force applied by the heat transfer sheet 60 can be suppressed. Besides, the inclination of the shaft in the bearing hole 51 can be definitely prevented.

In Modifications 3 and 5, grooves may be formed instead of the circular holes 85.

Although the laser printer 1 is described as an example of the image forming apparatus in the embodiment, the image forming apparatus of the present disclosure is not limited to the laser printer 1. The image forming apparatus may be, for example, a copier, a scanner or a multifunction peripheral.

The present disclosure embraces all the appropriate combinations of the embodiment and modifications descried above.

What is claimed is:

1. An optical scanning device comprising:

a rotating polygon mirror configured to deflection scan light emitted by a light source;

a motor configured to rotatively drive the rotating polygon mirror;

a substrate having a drive circuit part for controlling the motor;

a heat releasing member configured to release heat generated from the substrate; and a heat transfer member sandwiched between the substrate and the heat releasing member to be compressively deformed, wherein a receiving portion that part of the heat transfer member compressively deformed enters is formed in a first part of the heat releasing member in which the heat transfer member is provided, a plurality of convexes are provided in the first part, and the receiving portion corresponds to a concave formed between adjacent ones of the plurality of convexes.

2. An optical scanning device according to claim 1, wherein a bearing hole catching a shaft member of the motor is formed in the substrate, a plurality of concaves are formed in the first part, and a concave, out of the plurality of concaves, disposed on a side closer to the bearing hole has a larger volume than a concave disposed on a side farther from the bearing hole.

3. An optical scanning device according to claim 1, wherein a bearing hole catching a shaft member of the motor is formed in the substrate, each of the convexes is in the shape of a substantially rectangular parallelepiped extending from a first side of the first part closer to the bearing hole to a second side of the first part farther from the bearing hole, and the depths of the concaves are larger from the second side toward the first side.

4. An image forming apparatus comprising an optical scanning device according to claim 1.

5. An optical scanning device comprising:

a rotating polygon mirror configured to deflection scan light emitted by a light source;

a motor configured to rotatively drive the rotating polygon mirror;

a substrate having a drive circuit part for controlling the motor;

a heat releasing member configured to release heat generated from the substrate; and a heat transfer member sandwiched between the substrate and the heat releasing member to be compressively deformed, wherein a receiving portion that part of the heat transfer member compressively deformed enters is formed in a first part of the heat releasing member in which the heat transfer member is provided, a first member having a wavy top surface is provided in the first part, and the receiving portion corresponds to each concave of the wavy top surface of the first member.

6. An image forming apparatus comprising an optical scanning device according to claim 5.

7. An optical scanning device comprising:

a rotating polygon mirror configured to deflection scan light emitted by a light source;

a motor configured to rotatively drive the rotating polygon mirror;

a substrate having a drive circuit part for controlling the motor;

a heat releasing member configured to release heat generated from the substrate; and a heat transfer member sandwiched between the substrate and the heat releasing member to be compressively deformed, wherein a receiving portion that part of the heat transfer member compressively deformed enters is formed in a first part of the heat releasing member in which the heat transfer member is provided, a plurality of holes or grooves are formed in the first part, the receiving portion corresponds to each of the holes or grooves, a bearing hole catching a shaft member of the motor is formed in the substrate, and a hole or groove, out of the plurality of holes or grooves, disposed on a side closer to the bearing hole has a larger volume than a hole or groove disposed on a side farther from the bearing hole.

8. An image forming apparatus comprising an optical scanning device according to claim 7.

* * * * *